US006039860A

United States Patent [19]

Cooper et al.

[11] Patent Number: 6,039,860

[45] Date of Patent: Mar. 21, 2000

[54] METHOD FOR CHROMIUM PLATING TITANIUM ALLOY

[75] Inventors: Austin M. Cooper, Aliso Viejo; Robert M. Hazencomb, Lake Forest; Albert W. Silva, Temecula; Robert William Wright, Garden Grove, all of Calif.

[73] Assignee: McDonnell Douglas Corporation, Seal Beach, Calif.

[21] Appl. No.: 09/188,731

[22] Filed: Nov. 9, 1998

[51] Int. Cl.[7] ..... C25D 5/34; C25D 5/52; C23C 22/24

[52] U.S. Cl. ..... 205/208; 205/206; 205/222; 148/264

[58] Field of Search ..... 205/206, 208, 205/222; 148/264

[56] References Cited

U.S. PATENT DOCUMENTS

| | | | |
|---|---|---|---|
| 4,846,940 | 7/1989 | Neuhauser et al. | 204/16 |
| 4,904,352 | 2/1990 | Witts | 204/32.1 |

OTHER PUBLICATIONS

L. Missel, Electroplating on Titanium Alloys, *Metal Finishing*, Sep., 1957, pp. 46–54.

*Primary Examiner*—Edna Wong
*Attorney, Agent, or Firm*—Alston & Bird LLP

[57] ABSTRACT

A method for chromium plating a part made of titanium or titanium alloy eliminates the conventional chemical cleaning of the part prior to electroplating, and instead employs a mechanical cleaning of the part including degreasing the part and then grit-blasting the part with aluminum oxide particles. Immediately following the grit-blasting step, for example within one minute of its completion, the part is connected to the negative terminal of a DC power supply and is then immersed into a bath of chromium plating solution which contains an anode element connected to the positive terminal of the power supply. The part is left in the bath for a period of time so as to deposit a plating of chromium on the surface of the part. For final finishing of the part, a post-plating grinding operation is performed in which the surface speed of the grinding wheel is not greater than about 6500 surface feet per minute and the in-feed rate is less than about 0.00015 inch per pass of the grinding wheel, and preferably is about 0.0001 inch per pass.

16 Claims, 2 Drawing Sheets

METHOD FOR CHROMIUM PLATING TITANIUM ALLOY

FIELD OF THE INVENTION

The present invention relates to electroplating and, more particularly, to electroplating chromium onto parts made of titanium or alloys thereof.

BACKGROUND OF THE INVENTION

Titanium alloys are widely used in aeronautical and aerospace applications and other applications where it is desirable to minimize the weight of mechanical structures, because of the high strength-to-weight ratios that titanium alloys offer. However, in terms of surface characteristics, titanium alloys suffer from some disadvantages. Specifically, titanium alloys are prone to galling and seizing when placed in loaded sliding contact with parts made of either titanium alloy or other metals. Additionally, titanium alloys are prone to oxidation at elevated temperatures.

For at least these reasons, parts made of titanium alloys are frequently plated with chromium when they are to be used in bearings or the like where they will be in sliding contact with other parts. Chromium plating substantially reduces the problem of galling and seizing of titanium parts. Chromium also has good anti-corrosion properties relative to titanium.

Chromium is typically electroplated onto a titanium part. In a conventional electroplating process for plating chromium onto titanium, after the surface of the part to be plated is cleaned and degreased, the surface is activated so that it will be more-receptive to the chromium plating and thus improve the strength of the bond between the titanium substrate and the chromium plating. The activation is conventionally accomplished by immersing the part in a series of chemical solutions. As described in "Electroplating on Titanium Alloys" by Leo Missel, published in the September 1957 issue of "Metal Finishing", Ti6-4 alloy (a titanium alloy containing 6 percent aluminum and 4 percent vanadium) is activated by first immersing the part in a solution of hydrofluoric acid and nitric acid, then immersing the part in a solution of sodium dichromate and hydrofluoric acid. The part is then rinsed with tap water and is transferred to a chromium bath for electroplating.

The activation solutions can be hazardous to workers who perform the process or work near the plating apparatus, and consequently the solutions are frequently subject to regulatory restrictions in terms of their use. The solutions are also prone to being contaminated and thus must periodically be replaced. Accordingly, the contaminated solutions must be disposed of, which poses hazards to the environment. Furthermore, the activation process is time consuming. For example, the aforementioned Missel article recommends immersing the part in the sodium dichromate-hydrofluoric acid solution for 20 minutes.

Accordingly, it would be desirable to provide a method for electroplating chromium onto titanium which does not require the use of hazardous chemicals for activating the titanium surface prior to electroplating the part. Additionally, it would be desirable to provide a chromium electroplating process for titanium which does not require any chemical activation step prior to electroplating the part.

SUMMARY OF THE INVENTION

The above needs are met and other advantages are achieved by the present invention, which provides a method for electroplating chromium onto a surface of a part made of titanium or an alloy thereof, in which no chemical activation step is performed prior to electroplating the part and in which the bond achieved between the titanium and the chromium plating is sufficiently strong for most if not all applications. The invention in a preferred embodiment comprises a method including a pre-plating step of mechanically cleaning the surface of the part in order to remove impurities. The cleaning preferably is carried out by grit-blasting the surface.

Immediately after the cleaning step, preferably within three minutes and more preferably within one minute, the part is electrically connected to the negative terminal of a direct current power supply and while the part is electrically "live" it is immersed in a bath of chromium plating solution containing an anode element which is connected to the positive terminal of the power supply. The part must be connected to the power supply prior to being immersed so that the surface of the part is not passivated by the plating solution prior to the start of electroplating as is the case with conventional electroplating techniques which do not connect the part to the power supply until the part has been immersed in the plating solution. The part is left in the bath for a sufficient time to build up a plating of the desired thickness, and is then removed and rinsed.

After the plating operation, the part is prepared to final dimensions by grinding the chromium plating with a rotating grinding tool. Chromium has very low ductility, and therefore chromium plating is prone to fracturing and flaking when subjected to hard impacts. However, the inventors have discovered that the chromium plating can be successfully ground without substantial problems of fracturing and flaking of the chromium plating by reducing the speed of the grinding tool substantially below the 7200–7500 surface feet per minute speeds that are conventionally used. Thus, in accordance with a preferred embodiment of the invention, the post-plating grinding operation is performed with a rotating grinding tool which moves at a peripheral speed relative to the surface of not more than about 6500 surface feet per minute. Preferably, a low in-feed rate to the grinding tool is used. For example, the in-feed rate is preferably less than 0.00015 inch per pass of the tool, and more preferably is about 0.0001 inch or less per pass.

In a further preferred embodiment of the invention, the current applied by the power supply is initially set at a relatively high value when the part is first immersed and continuing for a period of time thereafter. For example, the initial current preferably is sufficient to create a current density of about 2.5 to 5 amps per square inch of surface area being plated, depending on the temperature of the plating bath.

After a period of time, for example 1 to 10 minutes, the current density is reduced, for example to about 1 to 2 amps per square inch. It is believed that the initial high current density achieves a rapid deposition of chromium molecules onto the titanium surface so as to minimize the passivation of the surface by the plating solution.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF PREFERRED EMBODIMENTS

Figure 1:
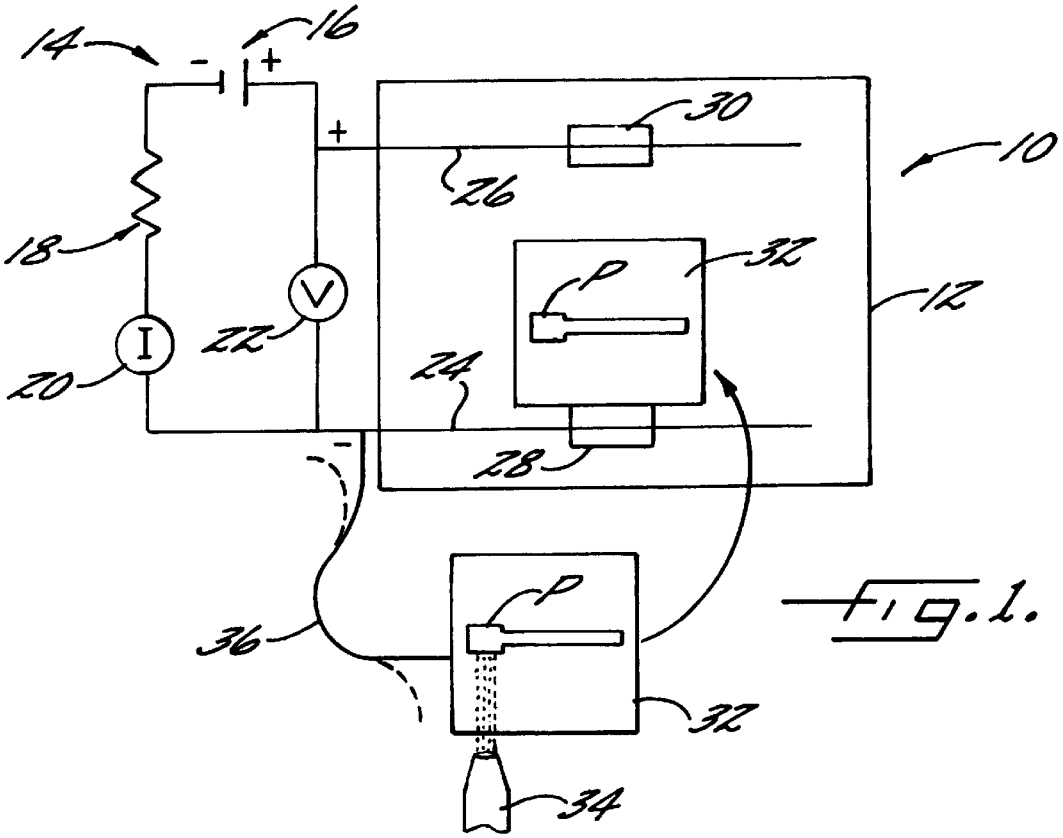
FIG. 1 is a schematic top elevational view of a plating apparatus suitable for performing a plating method in accordance with the invention.

With reference to FIG. 1, a plating apparatus 10 is shown which is suitable for practicing methods in accordance with the invention. The apparatus 10 includes a tank 12 containing a chromium plating solution, a power supply 14 having a direct-current voltage source 16 which is adjustable for varying the voltage potential between its positive and negative terminals, an adjustable resistance element such as a rheostat 18 or equivalent device for varying the current supplied to the plating electrodes in the tank 12, and an ammeter 20 and volt meter 22 for measuring the current and voltage, respectively, applied to the electrodes. A cathode bar 24 is connected to the negative terminal of the power supply 14 and extends into the tank 12; similarly, an anode bar 26 is connected to the positive terminal of the power supply 14 and extends into the tank 12. At least one cathode 28 is connected to the portion of the cathode bar 24 inside the tank, and at least one anode 30 is connected to the portion of the anode bar 26 inside the tank.

The apparatus 10 further includes a plating fixture 32 which is shown in two alternate positions inside and outside the tank in FIG. 1. The plating fixture 32 is adapted to hold a part P to be plated such that an electrical connection exists between the fixture 32 and the part P. As shown in FIG. 1, the plating fixture 32 is also adapted to permit the part P to be grit-blasted while contained in the fixture. The plating fixture 32 and the cathode 28 are adapted to make electrical contact with each other when the plating fixture 32 is placed into the tank 12. Thus, when the plating fixture 32 containing the part P is placed into the tank 12, an electrical connection is made between the cathode 28 and the part P. When the fixture 32 containing the part P is immersed in the plating solution in the tank 12, the power supply 14 is operated to supply current between the part P and the anode 30, which causes chromium to be deposited onto the surface of the part P.

Figure 2:
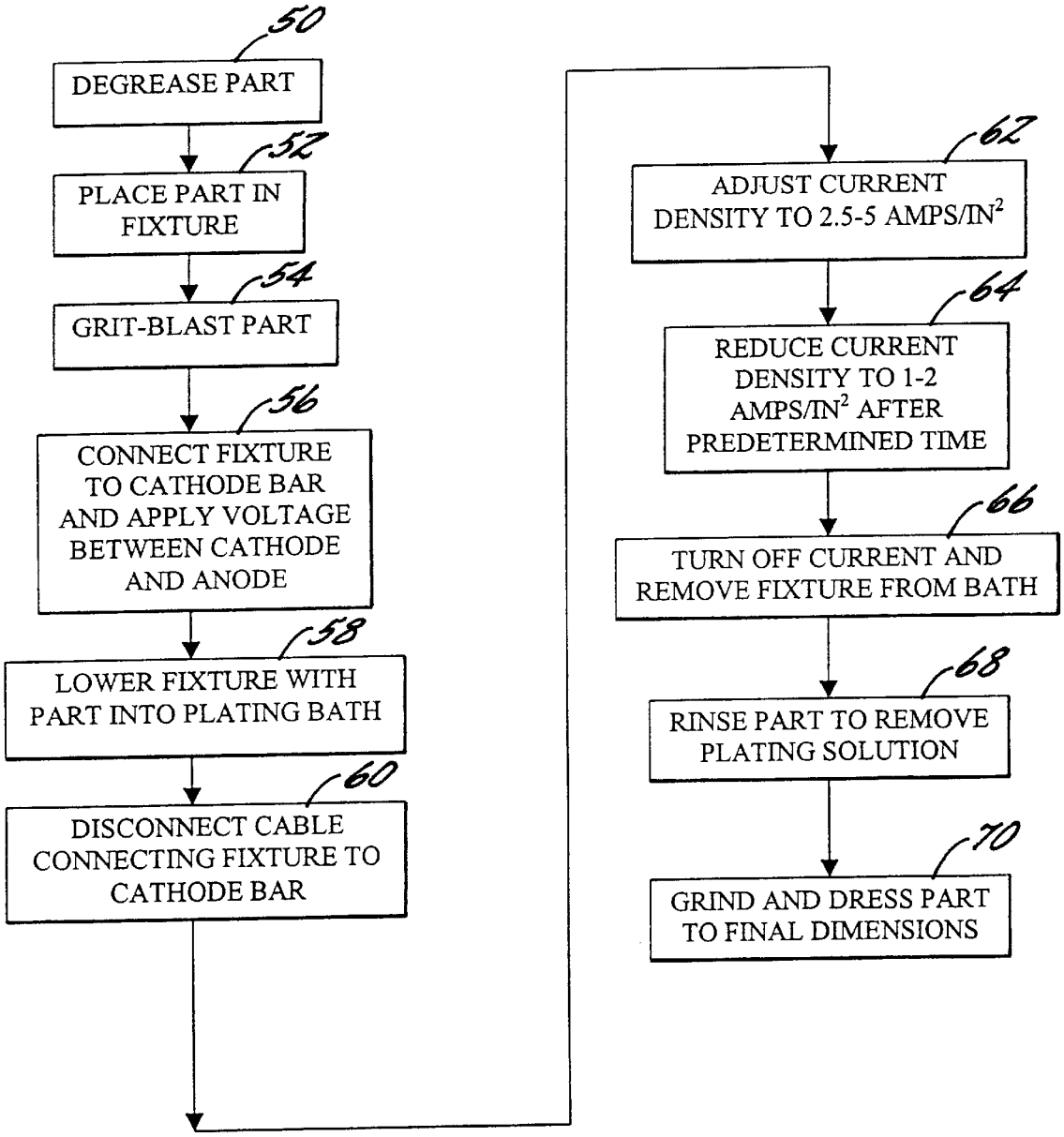
FIG. 2 is a block process diagram depicting steps of a method for chromium plating a titanium part in accordance with a preferred embodiment of the invention.

In accordance with a preferred embodiment of the invention, and with reference to FIG. 2, the part P is plated with chromium by the following method. At 50 in FIG. 2, the part P is first degreased to remove oil and grease on the surface of the part. The degreasing preferably includes the step of wiping the surface of the part P with a strong solvent such as isopropanol, acetone, methyl ethyl ketone, or the like, until a water break-free condition is obtained on the surface of the part. At 52, without touching the surface of the part with the hands, the part P is placed into the fixture 32. At 54, the part is then cleaned by using a grit-blasting device 34 (FIG. 1) to thoroughly abrasively clean the surface of the part. The grit-blasting device preferably uses about 180-grit particles of aluminum oxide at about 60 psig. After the abrasive cleaning of the part is completed, any loose particles of aluminum oxide are removed from the part using forced, clean, dry air.

The electroplating operation must begin within three minutes of the completion of the grit-blasting operation, and more preferably within one minute, because the surface of the part begins to oxidize immediately after the cleaning is completed and it is desired to minimize the amount of oxidation. Even more importantly, the part P must go into the tank "live" as further described below. Thus, at 56, a jumper cable 36 is connected between the cathode bar 24 and the plating fixture 32. The power supply 14 is adjusted so that a voltage potential of about 7 volts DC is applied across the terminals of the power supply. Thus, the part P is "live" (i.e., it is at a different electrical potential then the anode 30) while still outside the tank 12. At 58, the fixture 32 and part P are lowered into the tank 12 so as to engage the cathode 28 to establish an electrical connection between the fixture 32 and the cathode 28. At 60, the jumper cable 36 is then disconnected from the cathode bar 24 and the plating fixture 32. By immersing the part P while it is live, there is essentially no time during the immersion at which electroplating is not occurring for any given portion of the surface of the part. In contrast, with conventional electroplating methods, the part is immersed in the plating solution and is subsequently connected to one of the electrodes (typically the cathode, although sometimes the polarity is initially reversed from its normal polarity so as to initially etch the part, the polarity then being switched after a period of time to begin plating the part). As a result, with the conventional method there is a period of time during which electroplating does not occur but the part is exposed to the plating solution. Chromic acid used in chromium plating solutions is a very strong oxidizer which rapidly passivates the surface of titanium so that a relatively weak bond is formed between the surface and the chromium plating. While not wishing to be bound by theory, it is believed that by using the method of the present invention, electroplating begins immediately upon contact of the part with the plating solution, and accordingly a relatively stronger bond is achieved with the chromium plating than would be the case if the part were not live when placed into the plating tank.

At 62, the power supply 14 is adjusted so that the current supplied is sufficient to create a current density of between about 2.5 and 5 amps per square inch of surface area of the part P being plated. This current density is significantly higher than the current densities conventionally employed in electroplating titanium, which typically range from about 1 to 2 amps per square inch. The high current density is continued for a period of time, preferably from about 1 to 10 minutes, although the length of time at the high current density is not critical. Thereafter, at 64, the current is reduced to give a current density of about 1–2 amps per square inch. The plating is allowed to proceed at the reduced current density such that chromium plating builds up on the surface of the part P at a rate of about 0.0005 inch per hour, until the desired thickness of chromium plating is obtained. At 66, the current is then turned off and the fixture and part are removed from the tank. At 68, the part is rinsed with water to remove the plating solution. Finally, at 70, the part is ground and dressed to final dimensions. Of course, if the final dimensions of the part are not critical, the post-plating grinding operation can be omitted.

Figure 3:
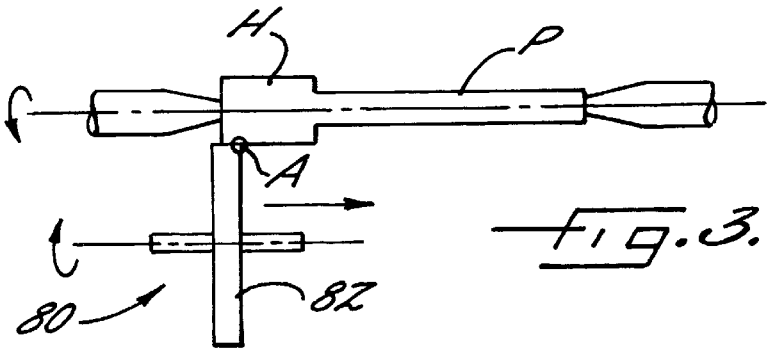
FIG. 3 is a schematic top elevational view of a grinding apparatus performing a post-plating grinding operation on a chromium-plated titanium part in accordance with a preferred embodiment of the invention.
Figure 4:
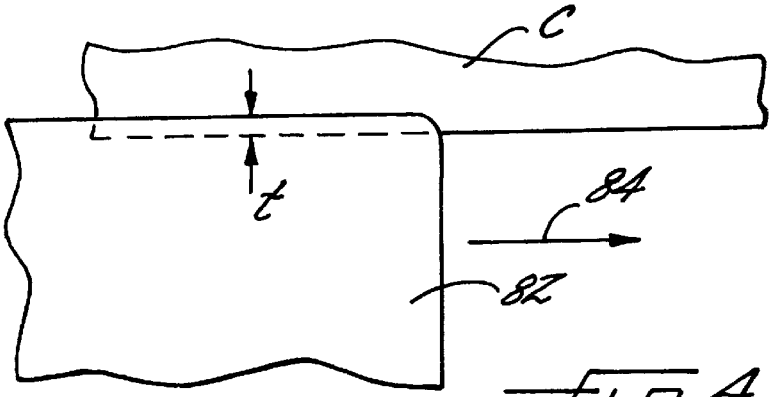
FIG. 4 is a greatly enlarged view of a portion of FIG. 3 schematically illustrating the in-feed rate for the post-plating grinding operation.

The grinding process is an important aspect of the invention. Chromium has very low ductility, and therefore chromium plating is prone to fracturing and flaking when subjected to hard impacts such as during a grinding operation. However, the inventors have discovered that the chromium plating can be successfully ground without substantial problems of fracturing and flaking of the chromium plating by reducing the speed of the grinding tool substantially below the 7200–7500 surface feet per minute speeds that are conventionally used, and by using a very low in-feed rate. With reference to FIGS. 3 and 4, a grinding apparatus 80 is schematically depicted for grinding a part P after a chromium plating operation. The grinding apparatus 80 comprises a rotating grinding wheel 82. The part P illustrated in FIG. 3 is a body of revolution such as a piston for a hydraulic cylinder. Accordingly, a grinding operation is advantageously performed by rotating the part P about its longitudinal axis at a relatively low rotational speed, for example about 80–100 rpm, and bringing the grinding wheel 82 into contact with the rotating surface of the part. With reference to FIG. 4 which shows on a greatly enlarged scale the region A of FIG. 3, the grinding wheel 82 is initially moved or "plunged" in a direction generally normal to the axis of the part so that the wheel makes contact with the chromium plating C and removes a desired thickness t of the plating. The thickness t is referred to as the "in-feed" rate. The grinding wheel 82 is then moved relative to the part P parallel to the surface of the part P as indicated by arrow 84 so that a thickness t of chromium plating C is removed along a lengthwise-extending portion of the part P. For example, for the piston part P illustrated in FIG. 3, the entire head H of the part, which represents the portion of the piston that makes sliding contact with the inner surface of a hydraulic cylinder, is chromium plated and then ground to a desired diameter. The wheel 82 preferably is rotated about its axis such that the peripheral speed of the wheel 82 relative to the part is not greater than about 6500 surface feet per minute.

The in-feed rate is an important aspect of the grinding operation. The in-feed rate t preferably should be no greater than about 0.00015 inch per pass of the grinding wheel, and more preferably no greater than about 0.0001 inch per pass. Where the total thickness of chromium plating that must be removed is greater than the in-feed rate, multiple passes of the grinding wheel are performed. Thus, in order to minimize the time required for the post-plating grinding operation, it will be appreciated that the plating operation advantageously should be controlled such that the thickness of chromium plating deposited on the part is only slightly greater than the desired final dimension of the part.

The type of grinding wheel used is important to the success of the grinding operation. Preferably, grinding is performed with a silicon carbide wheel such as a 3SG-80JVS wheel manufactured by Norton or an equivalent wheel of about the same hardness. Where the lengthwise-extending portion of the part to be ground is greater than about 4 inches, the wheel advantageously should have a width of no more than about 2 inches so that the total contact time between the wheel and any given location on the surface of the part is minimized as much as practically possible.

Many modifications and other embodiments of the invention will come to mind to one skilled in the art to which this invention pertains having the benefit of the teachings presented in the foregoing descriptions and the associated drawings.

Therefore, it is to be understood that the invention is not to be limited to the specific embodiments disclosed and that modifications and other embodiments are intended to be included within the scope of the appended claims. For example, while the invention has been explained by illustrating the plating of a part P which is formed as a body of revolution, it will be understood that the invention is not limited to plating bodies of revolution but rather is applicable to a wide variety of part configurations.

Additionally, although the description and drawings refer to grit-blasting as the preferred method for cleaning a part prior to plating, other mechanical cleaning operations capable of removing substantially all surface contamination can be used instead. Although specific terms are employed herein, they are used in a generic and descriptive sense only and not for purposes of limitation.

What is claimed is:

1. A method for chromium plating a surface of a part made of titanium or an alloy thereof, comprising:

mechanically cleaning the surface of the part to remove impurities therefrom;

electrically connecting the part to a negative terminal of a direct current power supply; and while the part is connected to the negative terminal of the power supply, immersing the part in a bath of a chromium plating solution which contains an anode element connected to a positive terminal of the direct current power supply, and maintaining the part immersed for a period of time such that a plating of chromium is deposited on the surface of the part.

2. The method of claim 1, wherein the cleaning step comprises grit blasting the surface of the part.

3. The method of claim 2, wherein the cleaning step further comprises the step of wiping the surface of the part with a degreasing agent prior to the grit blasting step.

4. The method of claim 2, further comprising the steps, performed after the chromium plating is deposited on the surface, of removing the part from the bath and grinding the chromium plating with a rotating grinding tool having a peripheral speed relative to the surface of the part which is less than about 6500 surface feet per minute.

5. The method of claim 4, wherein the grinding step comprises contacting the plating of chromium with the periphery of a rotating grinding wheel, and passing the grinding wheel over the surface so as to remove a predetermined thickness of chromium from the part.

6. The method of claim 5, wherein the grinding step comprises removing less than about 0.00015 inch of chromium per pass of the grinding wheel over the surface.

7. The method of claim 5, wherein the grinding step comprises removing less than about 0.0001 inch of chromium per pass.

8. The method of claim 1, wherein the step of immersing the part in the bath and maintaining the part in the bath comprises initially subjecting the part to a relatively higher current density beginning when the part is placed into the bath, and subjecting the part to a reduced current density after a predetermined period of time.

9. The method of claim 8, wherein the part is initially plated at a current density of about 2.5–5 amps per square inch of surface area of the part.

10. The method of claim 9, wherein the current density is reduced to about 1–2 amps per square inch of surface area after the predetermined period of time has elapsed.

11. The method of claim 1, wherein the step of immersing the part in the bath is performed within three minutes of completing the mechanical cleaning step.

12. The method of claim 1, wherein th e mechanical cleaning step comprises the steps of wiping the surface of the part with a solvent and then grit-blasting the surface.

13. A method for chromium plating a surface of a part made predominantly of titanium, comprising the steps of:

degreasing the surface of the part;

after the degreasing step, grit-blasting the surface of the part;

within three minutes of completion of the grit-blasting step, electrically connecting the part to a negative terminal of a direct current power supply and thereafter immersing the part in a bath of chromic acid solution which contains an anode element connected to a positive terminal of the direct current power supply; and maintaining the part immersed for a period of time such that a plating of chromium is deposited on the surface of the part.

14. The method of claim 13, wherein the degreasing step includes a step of wiping the surface of the part with a solvent so as to develop a water break-free condition on the surface.

15. The method of claim 13, wherein the step of electrically connecting the part to the negative terminal of the power supply comprises applying an electrical potential of about 7 volts between the part and the positive terminal of the power supply.

16. The method of claim 13, further comprising the steps of removing the part from the bath after the plating has been deposited on the surface and grinding the chromium plating with a grinding wheel operating at a peripheral speed relative to the part of less than about 6500 surface feet per minute.

* * * * *